US012359606B2

(12) United States Patent
Malone

(10) Patent No.: US 12,359,606 B2
(45) Date of Patent: Jul. 15, 2025

(54) FLOW SCHEME WITH PUMP AND SWITCH

(71) Applicant: Cooper-Standard Automotive Inc., Northville, MI (US)

(72) Inventor: David S. Malone, Attica, MI (US)

(73) Assignee: Cooper-Standard Automotive Inc., Northville, MI (US)

( * ) Notice: Subject to any disclaimer, the term of this patent is extended or adjusted under 35 U.S.C. 154(b) by 0 days.

(21) Appl. No.: 18/473,234

(22) Filed: Sep. 23, 2023

(65) Prior Publication Data

US 2025/0101901 A1 Mar. 27, 2025

(51) Int. Cl.
*F01P 7/16* (2006.01)

(52) U.S. Cl.
CPC ..... *F01P 7/165* (2013.01); *F01P 2050/22* (2013.01); *F01P 2060/045* (2013.01); *F01P 2070/10* (2013.01)

(58) Field of Classification Search
CPC .. F01P 7/165; F01P 2050/22; F01P 2060/045; F01P 2070/10
USPC ..... 123/41.44
See application file for complete search history.

(56) References Cited

U.S. PATENT DOCUMENTS 6,257,177 B1 * 7/2001 Lehmann ..... F04D 15/0022 417/423.1
8,196,553 B2 * 6/2012 Kline ..... F01P 5/12 123/41.11
9,650,940 B2 * 5/2017 Kakehashi ..... B60K 6/22
9,726,068 B2 8/2017 Murai et al.
9,816,429 B2 * 11/2017 Murai ..... F01P 5/12
10,508,587 B2 * 12/2019 Gesa ..... F01P 3/02
10,605,150 B2 3/2020 Toyama et al.
2015/0129161 A1 * 5/2015 Nishikawa ..... B60H 1/00885 62/243
2016/0031288 A1 * 2/2016 Nishikawa ..... B60L 58/26 165/43
2016/0109163 A1 * 4/2016 Enomoto ..... F25B 13/00 62/160
2017/0028813 A1 * 2/2017 Enomoto ..... B60H 1/00899
2017/0184008 A1 * 6/2017 Nagai ..... F01P 3/02
2020/0056614 A1 * 2/2020 Blad ..... F04D 1/006
2020/0072238 A1 * 3/2020 Blad ..... F04D 13/06
2021/0245576 A1 * 8/2021 Smith ..... F01P 7/165
2021/0277987 A1 * 9/2021 Moore ..... F16H 57/0415
2022/0176774 A1 * 6/2022 Tang ..... B60H 1/3227

FOREIGN PATENT DOCUMENTS

CN 105201625 A * 12/2015 ..... F01P 9/00
CN 108506076 B 9/2018
CN 114905914 A * 8/2022 ..... B60H 1/00392

* cited by examiner

*Primary Examiner* — Hung Q Nguyen
*Assistant Examiner* — Anthony Donald Taylor, Jr.
(74) *Attorney, Agent, or Firm* — Paschall & Associates, LLC; James C. Paschall; Anthony Miologos

(57) ABSTRACT

A process and apparatus for cooling a heat generating component of a vehicle comprises a first pump operated to pump a coolant to at least a first beat absorbing device when the heat generating component is operating. A second pump is operated to pump the coolant to at least the first heat absorbing device when the heat generating component is caused to stop operating.

15 Claims, 4 Drawing Sheets

FLOW SCHEME WITH PUMP AND SWITCH

TECHNICAL FIELD

This disclosure is generally directed to thermal management systems. More specifically, it relates to a flow scheme for a thermal management system that uses a pump and switch for switching flow to heat generating or absorbing components.

BACKGROUND

In motor vehicles, in order to circulate coolant in a coolant circuit between the vehicle radiator and the internal combustion engine, mechanically driven coolant pumps are generally used. The coolant pumps are arranged between the vehicle radiator and the internal combustion engine driven by a belt using the drive power of the internal combustion engine. Current vehicle design in the automotive sector is directed towards increasing the fuel-efficiency of vehicles. For this purpose, for example, start-stop systems are used, which an internal combustion engine in the vehicle, for example when stopping at a red light, a railway barrier, etc., is temporarily switched off. As soon as the stop situation has ended, and the vehicle operator presses the gas pedal, the internal combustion engine is restarted. Due to the system-related shutdown of the internal combustion engine in such start-stop systems the operation of the coolant pump is also stopped. In particular, due to the stopping of the internal combustion engine no more drive power is transmitted by the belt drive to the mechanical coolant pump, so that its operation is stopped, and therefore no coolant is circulated in the coolant circuit. During high outside temperatures and at correspondingly high engine or coolant temperatures, stopping the circulation of coolant flowing in the coolant circuit due to the stopped engine can cause the temperature of the engine to rise beyond a safe permitted level.

Additionally, in conventional coolant circuits, much of the thermal energy in the circulating coolant is typically dissipated to the air by a heat exchanger, such as the radiator, heater core or a transmission oil cooler. Under normal operating conditions, an engine and transmission may only require nominal coolant flow to maintain proper temperature of internal components. However, under severe operating conditions an engine may require an increased coolant flow to maintain proper component temperatures. If a high flow rate coolant pump is used to provide a high coolant flow rate under severe conditions to prevent overheating, the amount of coolant flow will be excessive under normal operating conditions, resulting in parasitic energy losses within the engine and transmission. Under cold start conditions, an engine and transmission may also require increased coolant flow to achieve and maintain proper temperature of internal components.

In currently known coolant circuits used in engine driven vehicles separate auxiliary pumps and inlet switching valves are used with branched cooling circuit lines to provide auxiliary fluid pump flow and to switch coolant flow to the heat absorbing components of the vehicle, which results in high component costs. Therefore, it is an object of the present disclosure to provide an integrated pump and switch wherein the pump acts as an auxiliary fluid pump that can be selectively energized to pump fluid through a vehicle's cooling circuit and switched to control the flow of coolant through branched cooling circuits.

SUMMARY

This disclosure relates to a process for cooling a heat generating component of a vehicle comprising pumping a coolant from a first pump to at least a first heat absorbing device when the heat generating component is operating. The process further comprises pumping the coolant from a second pump to at least the first heat absorbing device when the heat generating component is caused to stop operating.

The disclosure also relates to an apparatus for cooling a heat generating component of a vehicle comprising a first pump operated to pump a coolant to at least a first heat absorbing device when the heat generating component is operating. A second pump is operated to pump the coolant to at least the first heat absorbing device when the heat generating component is caused to stop operating.

In an embodiment a first inlet of a switch integrated with the second pump is connected to an outlet of a second heat absorbing device. The first inlet directly communicates the coolant received at the first inlet from the outlet of the second heat absorbing device to the second pump. A second inlet of the switch is connected to an outlet of a third heat absorbing device. The switch is arranged to selectively communicate the coolant received at the second inlet from the outlet of the third heat absorbing device to the second pump.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DEFINITIONS

The term "communication" means that fluid flow is operatively permitted between enumerated components, which may be characterized as "fluid communication." The term "communication" may also mean that data or signals are transmitted between enumerated components which may be characterized as "informational communication."

The term "downstream communication" means that at least a portion of fluid flowing to the subject in downstream communication may operatively flow from the object with which it fluidly communicates.

The term "upstream communication" means that at least a portion of the fluid flowing from the subject in upstream communication may operatively flow to the object with which it fluidly communicates.

The term "direct communication" means that fluid flow from the upstream component enters the downstream component without passing through any other intervening vessel.

The term "bypass" means that the object is out of downstream communication with a bypassing subject at least to the extent of bypassing.

DETAILED DESCRIPTION

The figures discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
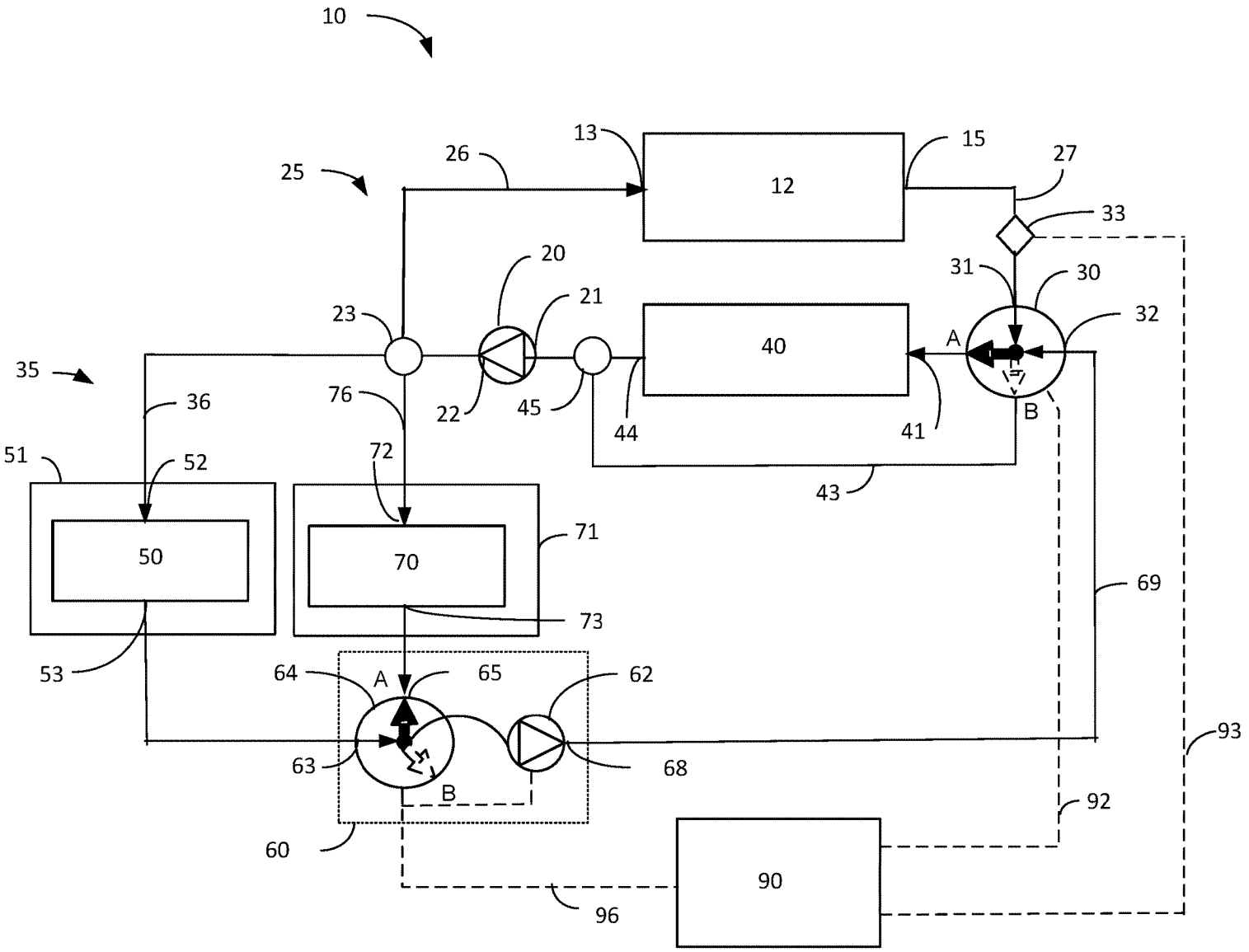
FIG. 1 illustrates a schematic view of a system of the present disclosure.

FIG. 1 depicts a system 10 for managing and regulating the temperature of the heat generating components of a vehicle such as its powertrain. The heat generating components of a vehicle powertrain typically includes an engine 12 and a transmission 71. Heat energy produced by the engine 12 is drawn from the engine by a coolant fluid circulating in the vehicle's engine through a series of coolant passageways including an engine inlet 13 and an engine outlet 15. The system 10 includes a pump 20 mechanically driven by the engine 12, a first valve 30, a pump and switch 60, a first heat absorbing device, such as for example a radiator 40, a second heat absorbing device, such as for example a heater core 50 installed in a passenger cabin 51, and a third heat absorbing device, such as a transmission oil heat exchanger 70 in direct communication with the transmission 71.

A first coolant circuit 25 supplies coolant fluid to the engine 12 using the mechanical pump 20, which has a pump inlet 21 and a pump outlet 22. The pump outlet 22 is fluidically connected to a fluid junction 23. The mechanical pump 20 is driven by a belt attached to the engine that operates mechanical pump 20 to drive coolant fluid through the first coolant circuit 25 as long as the engine 12 is running. The fluid junction 23 is in upstream communication with a coolant pipeline 26 of the first coolant circuit 25 and connected to engine inlet 13.

The flow of coolant to the radiator 40 is controlled by the first valve 30. The first valve 30 has a first valve inlet 31, a second valve inlet 32 and a first valve outlet A, and a second valve outlet B. The first valve inlet 31 is in downstream communication with engine outlet 15 via coolant pipeline 27. A second inlet 32 receives coolant from a return pipeline 69. The first valve 30 is arranged to have the coolant entering first valve inlets 31 and 32 switched to flow out of either first valve outlets A or B. The switching of the valve outlets may be made by an electrical actuator in any convenient manner, such as for example, an actuator. The actuator commanded by a control signal from a mode controller 90 via communication line 92. The mode controller 90 may also receive a sensor signal along communication line 93 from a temperature sensor 33. The sensor 33 is arranged to send signals representing the temperature of the coolant flowing through coolant pipeline 27 from engine 12.

The first valve 30 may be operated by the mode controller 90 to either apply the heat energy absorbed by the coolant from engine 12 to the radiator 40, or bypass around the radiator 40 to reapply the heated coolant back to the engine 12. For example, the first valve 30 may be selectively controlled to connect the downstream coolant line 27 to radiator inlet 41 through outlet A of the first valve 30. Heat energy is released from the coolant by passing the coolant through the radiator 40. In a situation where the engine 12 has not reached its operating temperature, sensed, and reported by sensor 33 to mode controller 90 temperature the mode controller may provide a command to first valve 30 to connect coolant line 27 to outlet B to use bypass pipeline 43. The bypass pipeline 43 directs the coolant downstream from the engine outlet 15 around the radiator 40 to fluid junction 45 and the inlet 21 of mechanical pump 20.

Heat energy may also be released from the coolant fluid by passing the coolant through a second coolant circuit 35. The second coolant circuit 35 comprises a heater core (HTC) 50 having an HTC inlet 52 and an HTC outlet 53 and a transmission oil cooler (TOC) 70 having a TOC inlet 72 and a TOC outlet 73. The HTC inlet 52 is in fluid communication with the fluid junction 23 on the upstream side of mechanical pump 20. Heat energy may further be exchanged between the coolant in the second coolant circuit 35 and a transmission oil using the TOC 70. The transmission oil lubricates and exchanges heat energy with the transmission 71. The TOC inlet 72 is in fluid communication with the fluid junction 23, upstream from mechanical pump 20. Coolant pumped though the outlet 22 of mechanical pump 20 flows into fluid junction 23 and through both a coolant pipeline 36 to the HTC inlet 52 and a coolant pipeline 76 to the TOC inlet 72.

The return side of the second coolant circuit 35 is connected in downstream communication with the first coolant circuit 25 through the pump and switch 60. The pump and switch 60 comprises, as an integrated unit, an electrically driven auxiliary fluid pump 62 and a switch 64. A first inlet 63 of switch 64 is fluidically connected to HTC outlet 53. A second inlet 65 of the switch 64 is fluidically communicated to TOC outlet 73. Coolant flowing downstream from the HTC 50 returns to the first coolant circuit 25 through the first inlet 63 of valve switch 64. The first inlet 63 is unswitched and therefore passes all the coolant received through the switch 64 to auxiliary pump 62. The coolant flows through the auxiliary pump 62, where it exists from an outlet 68 to the second input 32 of the first valve 30 via return pipeline 69.

Downstream coolant flows from the TOC 70 exits TOC outlet 73 and is connected to the second inlet 65 of the switch 64. With switch 64 in position A, coolant from the TOC 70 passes through switch 64 to auxiliary pump 62 where it is mixed with the coolant from the HTC 50 to exit from outlet 68 and return to the second input 32 of the first valve 30 via return pipeline 69.

Both the auxiliary pump 62 and the switch 64 are arranged to be energized by signals provided by the mode controller 90. The mode controller 90 outputs control signals via communication line 96 to pump and switch 60. The mode controller 90 provided power and control signals to place the pump and switch 60 into selected operational modes based on various vehicle operating conditions.

Under normal driving conditions, the transmission oil may not require cooling, and therefore, the mode controller 90 may send control signals to the pump and switch 60 to place the switch 64 into a first operational mode. In the first operational mode, inlet 65 is moved to position B that blocks coolant from flowing through the switch 64. In the first operational mode, coolant from TOC outlet 73 is stopped from flowing through the TOC exchanger 70.

However, under severe operating conditions, such as when for example, driving in extremely hot air temperatures or when hauling a trailer, the transmission 71 may require that heat energy built up in the transmission oil be cooled in order to maintain proper operating temperatures. In such operating conditions, the switch 64 may be placed into a second operational mode by mode controller 90 by sending control signals to switch 64 to place valve inlet 65 into position A. In this second operational mode, coolant frows out of TOC outlet 73, through switch 64 and out of auxiliary pump 62 through outlet 68 to second inlet 32 of the first valve 30 and to the first coolant circuit 25.

In order to maximize fuel efficiency modern internal combustion engines, employ start-stop systems to temporarily switch off or stop the engine 12 when for example stopping at a red light, a railway barrier, etc. As soon as the stop situation has ended, and the vehicle operator presses the gas pedal, the engine 12 is restarted. Due to the system-related shutdown of the engine 12 in such start-stop systems, the operation of the mechanical coolant pump, such as mechanical pump 20, is also stopped. In particular, due to the stopping of the engine 12 no more drive power is transmitted by a belt drive that drives the mechanical pump 20, so that its operation is stopped, and therefore no coolant is circulated in the coolant circuits 25 and 35. During high outside temperatures and at correspondingly high engine or coolant temperatures, stopping the circulation of coolant flowing in the system 10 due to the stopped engine can cause the temperature of the engine 12 to rise beyond a safe permitted level.

The mode controller 90 may send control signals to the pump and switch 60 to place it in a third operational mode. In the third operational mode, the mode controller 90 signals the auxiliary pump 62 through communication line 96 to turn-on the auxiliary pump 62. With the auxiliary pump 62 energized coolant fluid is pumped through system 10 effectively replacing the pumping action provided by mechanical pump 20 which is in a stopped condition due to the engine 12 being shutdown. The auxiliary pump 62 is electrically driven using a vehicles battery or other source of stored electrical energy. The auxiliary pump 62 pumps the coolant fluid entering into switch inlet 63 from HTC outlet 53 and from switch inlet 65 from TOC outlet 73. The coolant fluid is pumped from switch inlet 65 only if switch inlet 65 is in valve position A. Auxiliary pump 62 pumps fluid from outlet 68 into coolant return pipeline 69 to the first valve 30 and into the engine 12 and radiator 40 of the first coolant circuit 25. The auxiliary pump 62 remains on until the engine 12 is restarted and the mechanical pump 20 takes over pumping coolant through system 10. Upon restarting engine 12, the mode controller sends commands to the auxiliary pump 62 to cease operation which turns-off the auxiliary pump 62. The mechanical pump 20 again takes on the duty of circulating the fluid through the system 10 driven by the engine 12.

Figure 2:
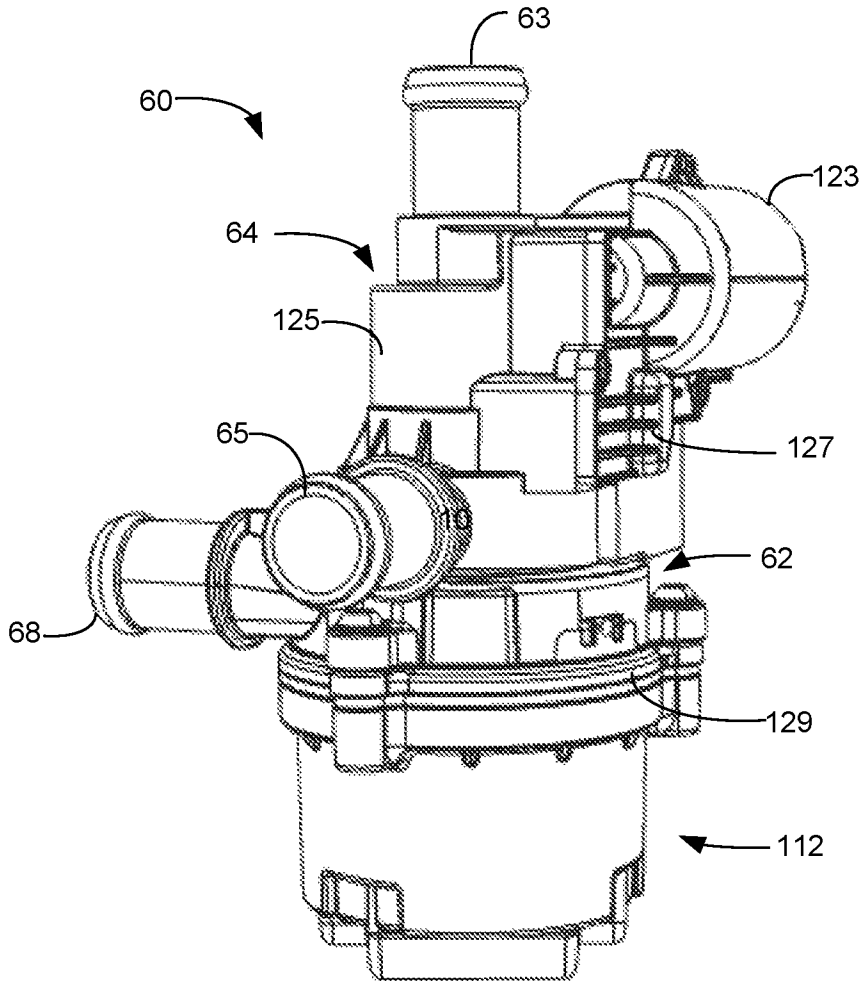
FIG. 2 illustrates a perspective view of a pump and switch of the present disclosure.
Figure 3:
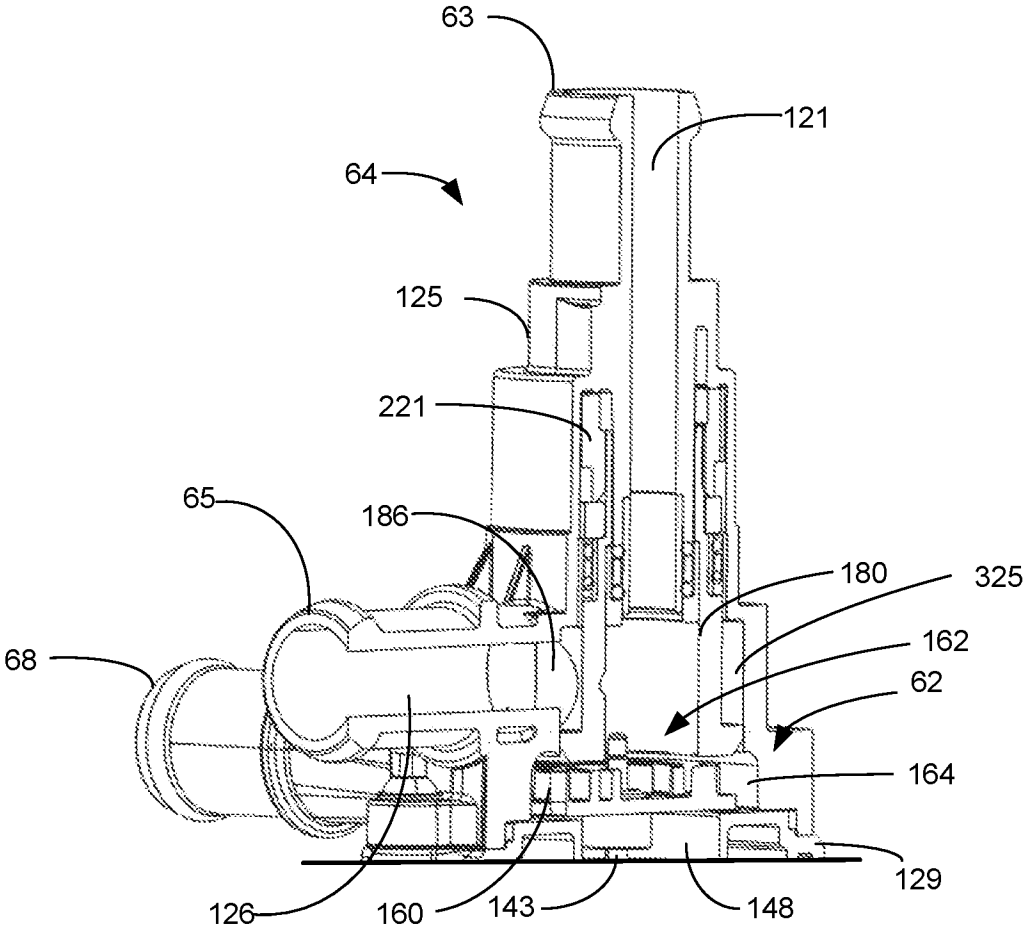
FIG. 3 illustrates a first cross-sectional perspective view through an upper housing of the pump and switch of FIG. 1 of the present disclosure.
Figure 4:
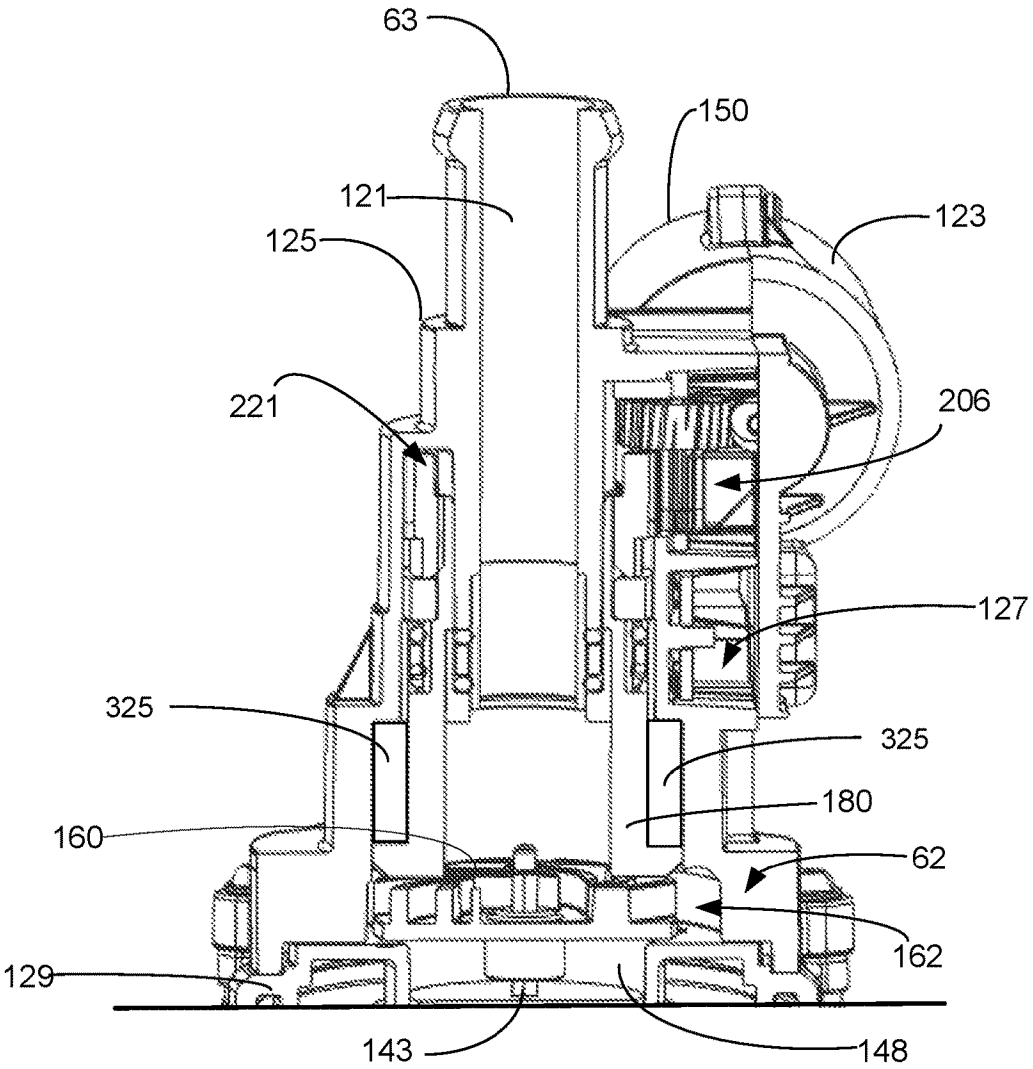
FIG. 4 illustrates a second cross-sectional perspective view of the upper housing of the pump and switch of FIG. 1 of the present disclosure.

FIGS. 2-4 illustrate an example pump and switch 60 of the present disclosure. The pump and switch 60 comprises, as an integrated unit, a motor section 112, a switch section 64, and a pump section 62. The first inlet 63 extends outward from the switch section 64 providing the non-switched inlet for coolant to flow to the pump section 62 through a passage 121. The second coolant inlet 65 includes a passage 126 that extends into the switch section 64 and to a rotatable valve switch 180. The valve switch 180 is arranged to be switched into an open or closed position to permit or to block fluid flow to the pump section 62 from the second inlet 65. An actuator 50 seen in FIG. 4, is housed in an actuator cover 23 mounted on the switch section 64. The actuator 150 is arranged to rotate the valve switch 180 to position the valve switch into the closed B position of the first operating mode to the open A position of the second operating mode when the actuator 50 is energized by the mode controller 90, as was explained above.

The switch section 64, the first inlet 63, the second inlet 65, the pump section 62 and the outlet 68 are integrated into a singular upper housing 25 formed from a suitable glycol and temperature resistant thermoplastic material. The actuator cover 123 houses the actuator 150 therein.

The motor section 112 includes an intermediate cover member 129, shown in FIGS. 3 and 4. A top surface of the intermediate cover member 129 forms a floor for the pump section 62. An impeller 160 is rotationally mounted over the floor and is enclosed within a pump cavity 162 formed in the interior of the pump section 62. A chamber 148 extends from a bottom surface of the intermediate cover member 129. Chamber 148 houses an electrical motor (not shown) having a motor shaft 143 attached to the electrical motor. The electrical motor may be connected to electrical terminals (not shown) that electrically connect to communication line 96 from mode controller 90. Communication line 96 provides control signals as electrical pulses to the electrical motor to energize the electrical motor and control its rotation, speed, and torque.

The auxiliary pump 62 comprises an impeller 160 rotating within a cylindrical pump cavity 162 formed by a circular wall 164. Rotation of the impeller 160 by motor shaft 143 causes fluid contained in pump cavity 162 to be discharged at an accelerated flow rate through outlet 68.

The valve switch 180 is mounted in a cavity 221 of the valve switch section 64. The cavity 221 extends through the upper housing 125 parallel to passage 121. The valve switch 180 is mechanically connected to the actuator 50 via toothed gear set 206, shown in FIG. 4. The actuator motor 150, when energized by mode controller 90 is arranged to rotate the valve switch 180 into position A or to a position B. In position A an opening 186 is aligned with passage 126. Coolant in passage 126 flows through opening 186 and into pump cavity 162. Rotation of the valve switch into position B moves opening 186 away from passage 126 blocking the flow of coolant from passage 126 to the pump cavity 162. A sealing member 325 is placed in a lower chamber of cavity 221 to prevent leaking of coolant from passage 126 when the valve switch 180 is placed into position B that moves opening 186 away from passage 126.

The upper housing 125 of switch section 16 may further include an electronics section 127 that may house electronic components (not shown) for driving the actuator 50. Control signals to the actuator 50 may be coupled to the electronic components in the electronics section 127 using electrical conductors extending from the electrical terminals that also connect the electrical motor to communication line 96. The control signals coupled from communication line 96 to the electronic components in the electronic section 127 causing the actuator 150 to rotate the valve switch 180.

It may be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," or "controller" within a claim is understood and intended to refer to structures known to those skilled in the relevant art, as further modified or enhanced by the features of the claims themselves and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A process for cooling a heat generating component of a vehicle, the process comprising:

pumping a coolant from a first pump to a first coolant circuit containing the heat generating component and a first heat absorbing device and to a second coolant circuit containing at least a second heat absorbing device and a third heat absorbing device;

connecting an integrated device comprising a second pump and a switch between the at least second and third heat absorbing devices and the first coolant circuit; and transmitting a first control signal from a mode controller to the integrated device to cause the switch to block a flow of the coolant from the at least third heat absorbing device to the second pump and to the first coolant circuit and allow a flow of the coolant from the at least second heat absorbing device to the second pump and to the first coolant circuit.

2. The process of claim 1, wherein the switch receives the coolant from the at least second heat absorbing device at a first inlet directing the coolant to the second pump, the second pump including an outlet connected to the first coolant circuit.

3. The process of claim 2, wherein the switch receives coolant from the at least third heat absorbing device at a second inlet.

4. The process of claim 3, wherein responsive to the mode controller transmitting a second control signal to the integrated device, the switch is operable to direct the coolant received at the second inlet to the second pump.

5. The process of claim 3, wherein responsive to the mode controller transmitting the first control signal to the integrated device, the switch is operable to block the coolant from the second inlet to the second pump.

6. The process of claim 4, wherein responsive to the mode controller transmitting a third control signal to the integrated device, the second pump is energized to pump the coolant from the outlet of the second pump to the first coolant circuit.

7. The process of claim 6, wherein the mode controller transmits the third control signal when the heat generating component is caused to stop operating.

8. An apparatus for cooling a heat generating component of a vehicle, the apparatus comprising:

a first pump operable to pump a coolant to a first coolant circuit containing the heat generating component and a first heat absorbing device and to a second coolant circuit containing at least a second heat absorbing device and a third heat absorbing device;

an integrated device including a second pump and a switch contained in a housing and fluidically connected to each the other by a passage in the housing, the integrated device fluidically connected to the at least second and third heat absorbing devices; and a communication link for transmitting control signals from a mode controller to the integrated device, wherein responsive to a first control signal transmitted from the mode controller via the communication link, the integrated device is placed into a first operating mode that positions the switch to block the coolant from the at least third heat absorbing device from flowing through the passage to the second pump and to the first coolant circuit and allow the coolant from the at least second heat absorbing device to flow through the passage to the second pump and to the first coolant circuit.

9. The apparatus of claim 8, wherein a first inlet of the switch is connected to an outlet of the second heat absorbing device, the switch receiving the coolant from the outlet of the second heat absorbing device and directing the coolant through the passage to the second pump, the second pump including an outlet connected to the first coolant circuit.

10. The apparatus of claim 9, wherein a second inlet of the switch is connected to an outlet of the third heat absorbing device.

11. The apparatus of claim 10, wherein responsive to the mode controller transmitting a second control signal via the communication link, the integrated device is placed into a second operating mode causing the switch to direct the coolant received at the second inlet of the switch into the passage to the second pump.

12. The apparatus of claim 11, wherein when the integrated device is placed into the first operating mode, the coolant received at the second inlet of the switch is blocked from entering the passage to the second pump.

13. The apparatus of claim 12, wherein responsive to the mode controller transmitting a third control signal via the communication link, the integrated device is placed operated into a third operating mode that energizes the second pump to pump the coolant to the first coolant circuit from the outlet of the second pump.

14. The apparatus of claim 13, wherein the mode controller is configured to transmit the third control signal via the communication link when the heat generating component is caused to stop operating.

15. A process for cooling a heat generating component of a vehicle, the process comprising:

pumping a coolant using a first pump driven by a first heat generating component when the heat generating component is operating, to a first coolant circuit containing the first heat generating component and a first heat absorbing device and to a second coolant circuit containing at least a second heat absorbing device;

connecting an integrated device comprising a second pump and a switch contained in a housing and fluidically connected to each other by a passage in the housing to the at least one second heat absorbing device and the first coolant circuit; and transmitting a control signal from a mode controller to the integrated device to cause the switch to direct the coolant from the at least one second heat absorbing device and the second coolant circuit to flow through the passage to the second pump to pump the coolant to the first coolant circuit when the heat generating component and the first pump are caused to stop operating.

* * * * *